US011031664B2

(12) United States Patent
Goulouev et al.

(10) Patent No.: US 11,031,664 B2
(45) Date of Patent: Jun. 8, 2021

(54) WAVEGUIDE BAND-PASS FILTER

(71) Applicant: COM DEV Ltd., Mississauga (CA)

(72) Inventors: Rousslan Goulouev, Aylesbury (GB); Jianming Chang, Cambridge (CA)

(73) Assignee: COM DEV Ltd., Mississauga (CA)

( * ) Notice: Subject to any disclaimer, the term of this patent is extended or adjusted under 35 U.S.C. 154(b) by 80 days.

(21) Appl. No.: 16/671,619

(22) Filed: Nov. 1, 2019

(65) Prior Publication Data

US 2020/0373644 A1 Nov. 26, 2020

Related U.S. Application Data

(60) Provisional application No. 62/851,767, filed on May 23, 2019.

(51) Int. Cl.
*H01P 1/208* (2006.01)
*H01P 7/06* (2006.01)

(52) U.S. Cl.
CPC ..... *H01P 1/2082* (2013.01); *H01P 1/208* (2013.01); *H01P 7/06* (2013.01)

(58) Field of Classification Search
CPC ..... H01P 1/207; H01P 1/208; H01P 1/2082; H01P 7/06
USPC ..... 333/212, 208, 209, 210
See application file for complete search history.

(56) References Cited

U.S. PATENT DOCUMENTS

| | | | |
|---|---|---|---|
| 2,585,563 A | 2/1952 | Lewis et al. | |
| 3,153,208 A | 10/1964 | Riblet | |
| 8,975,985 B2 | 3/2015 | Meuriche | |
| 2003/0206082 A1 | 11/2003 | Chen et al. | |
| 2014/0266514 A1* | 9/2014 | Rogozine | H01P 1/2002 333/212 |

FOREIGN PATENT DOCUMENTS

| | | |
|---|---|---|
| EP | 1564835 A1 | 8/2005 |
| WO | 2008/019307 A2 | 2/2008 |
| WO | 2015/042359 A1 | 3/2015 |
| WO | 2015/117680 A1 | 8/2015 |

OTHER PUBLICATIONS

Extended European Search Report dated Oct. 15, 2020 in EP Patent Application No. 20175297.9 (8 pages).

(Continued)

*Primary Examiner* — Stephan E. Jones
(74) *Attorney, Agent, or Firm* — Bereskin & Parr LLP/S.E.N.C.R.L., s.r.l.; Isis E. Caulder; T. Cameron Gale

(57) ABSTRACT

A bandpass filter has a plurality of resonant cavities. The plurality of resonant cavities are arranged into a sequence of adjacent resonant cavities. Each resonant cavity is configured to define the same fundamental resonant frequency. The filter includes a plurality of coupling irises, with one of the coupling irises positioned between each pair of adjacent resonant cavities. Each resonant cavity includes a plurality of cavity sections. Each resonant cavity includes a capacitive iris positioned coupling the cavity sections to one another. The frequency of secondary resonance modes varies amongst the resonant cavities in the plurality of resonant cavities.

15 Claims, 10 Drawing Sheets

(56) References Cited

OTHER PUBLICATIONS

Kurzrok "General Three-Resonator Filters in Waveguide", IEEE Transactions on Microwave Theory and Techniques, Jan. 1966, 14(1): 46-47.
Amari et al., "CIET-Analysis and Design of Folded Asymmetric H-Plane Waveguide Filters With Source-Load Coupling", IEEE, 30th European Microwave Conference, Oct. 2-5, 2000, Paris, France, pp. 1-4.
Bastioli, "Nonresonating Mode Waveguide Filters", IEEE Microwave Magazine, Sep./Oct. 2011, 12(6): pp. 77-86.
Bornemann et al., "Tolerance analysis of bypass-, cross- and direct coupled rectangular waveguide band-pass filters", IEEE Proc.-Microw. Antennas Propag., Jun. 2005, 152(3): 167-170.
Ruiz-Cruz et al., "Longitudinal Dual-Mode Filters in Rectangular Waveguide", IEEE MTT-S International Microwave Symposium Digest, Atlanta, GA, Jun. 15-20, 2008, pp. 631-634.
Amari et al., "Characteristics of Cross (Bypass) Coupling Through Higher/Lower Order Modes and Their Applications in Elliptic Filter Design", IEEE Transactions on Microwave Theory and Techniques, Oct. 10, 2005, 53(10:3135-3141.
Marco et al., "Low-cost Dual-mode Asymmetric Filters in Rectangular Waveguide", IEEE MTT-S International Microwave Symposium Digest (Cat. No. 01CH37157), Phoenix, AZ, May 20-24, 2001, pp. 1787-1790.
Arndt et al., "Asymmetric Iris Coupled Cavity Filters with Stopband Poles", IEEE MTT-S International Digest on Microwave Symposium, Dallas, TX, May 8-10, 1990, pp. 215-217.
Al-Mudhafar et al., "Investigation of Multipactor Effect in Microwave Components in the Presence of Fringing Fields", 44th European Microwave Conference, Rome, Italy, Oct. 6-9, 2014, IEEE, pp. 406-409.
De Paolis et al., "CAD Procedure for High-Performance Composite Corrugated Filters", IEEE Trans. Microw. Theory Tech., Sep. 2013, 61(9): 3216-3224.
Levy, "Tapered Corrugated Waveguide Low-Pass Filters", IEEE Trans. Microwave Theory Tech., Aug. 1973, 21(8): 526-532.
Levy, "Inhomogeneous Stepped-Impedance Corrugated Waveguide Low-Pass Filters", IEEE MTT-S Int. Microw. Symp. Dig., Jun. 2005, pp. 123-126.
Saad, "Novel Lowpass Harmonic Filters for Satellite Application", IEEE MTT-S Int. Microwave Symp. Dig., San Francisco, CA, May 30-Jun. 1, 1984, pp. 292-294.

* cited by examiner

WAVEGUIDE BAND-PASS FILTER

CROSS-REFERENCE TO RELATED APPLICATION

This application claims the benefit of the U.S. Provisional Application No. 62/851,767, filed on May 23, 2019, the entirety of which is incorporated herein by reference.

FIELD

The present subject-matter relates to band-pass filters, and more particularly to band-pass filters constructed using waveguides.

INTRODUCTION

The following is not an admission that anything discussed below is part of the prior art or part of the common general knowledge of a person skilled in the art.

In communication systems, various services transmit signals in specific frequency bands. Band-pass filters can be used to permit signal components in the specific frequency bands to be transmitted, while preventing signal components in other frequency bands from being transmitted. In particular, band-pass filters are commonly used in satellite multiplexer assemblies and other RF/microwave applications to control the range of signal frequencies that are transmitted.

Parameters such as the pass-band bandwidth, stop-band bandwidth, in-band return loss, in-band insertion loss, out-of-band rejection, variation and slope of the insertion loss, phase and group delay impact the effective operation of a band-pass filter. The stability of these parameters over a range of environmental conditions is also important in many applications. Besides electrical parameters, physical parameters such as the size, mass, manufacturability as well as the overall cost efficiency of the band-pass filter are also important, especially for applications in constrained systems such as satellite payloads. Often, the "best" filter for a given application will involve a trade-off between parameters that depends on the specific application requirements.

One type of bandpass filter (BPF) involves the use of waveguide structures. Although many types of waveguide band-pass filters have been developed, most are not capable of providing continuous broadband rejection of unwanted frequencies for all waveguide modes. In most cases, waveguide band-pass filters may be evanescent-mode based or require a cascade of two or more filters in order to provide bandpass functionality over a wide range of frequencies. Although, evanescent-mode operation may provide compact, light and often inexpensive filters, these filters often have high in-band insertion loss and low power handling (peak and CW). A cascaded approach may provide a low-loss and high power filter assembly by cascading a high-Q BPF with a waveguide low-pass filter (LPF), but this usually results in a filter assembly with increased size and weight as well as increased overall cost.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In an aspect of this disclosure, a waveguide band-pass filter can define a wideband filter passband that provides effective rejection of frequencies above and below the pass band. The waveguide bandpass filter can be constructed using a plurality of resonators. The resonators can be defined with the same fundamental resonance frequency and different spurious frequency responses. The spurious frequency responses can be scattered across the stopband, in the region near the passband, so that these spurious responses are attenuated at least in the near vicinity of the passband. In some cases, the spurious frequencies can be rejected in the stopband up to at least the second harmonic resonances. The configuration of resonators used in the bandpass filter may enable high power handling, good frequency selection, and simplified manufacturing while also providing the filter with reduced size and mass.

In accordance with this aspect, there is provided a band-pass filter comprising: a plurality of resonant cavities, each resonant cavity configured to define the same fundamental resonant frequency, the plurality of resonant cavities arranged into a sequence of adjacent resonant cavities; a plurality of coupling irises, with one of the coupling irises positioned between each pair of adjacent resonant cavities; wherein each resonant cavity includes a plurality of cavity sections; each resonant cavity includes a capacitive iris positioned coupling the cavity sections to one another; and the frequency of secondary resonance modes varies amongst the resonant cavities in the plurality of resonant cavities.

In some embodiments, each resonant cavity may have a rectangular outer profile.

In some embodiments, the size of the rectangular outer profile may vary amongst the resonant cavities in the plurality of resonant cavities.

In some embodiments, each capacitive iris may be positioned centrally within the corresponding resonant cavity.

In some embodiments, the plurality of resonant cavities may include a plurality of H-shaped resonant cavities.

In some embodiments, the plurality of resonant cavities may include a plurality of Π-shaped resonant cavities.

In some embodiments, a filter may include the bandpass filter cascaded with a lowpass filter. A cascade filter may be provided including a bandpass filter defined in accordance with the embodiments described herein and a lowpass filter cascaded together.

In some embodiments, the fundamental resonant frequency of the plurality of resonant cavities may be selected to define a passband in the range of 3.4 GHz to 4.2 GHz.

In some embodiments, the plurality of resonant cavities may include an input resonant cavity, at least one intermediate resonant cavity, and an output resonant cavity; the input resonant cavity, at least one intermediate resonant cavity, and output resonant cavity are arranged into the sequence from the input resonant cavity to the output resonant cavity with the at least one intermediate resonant cavity positioned between the input resonant cavity and the output resonant cavity; the input resonant cavity is connected to a signal input interface; and the output resonant cavity is connected to a signal output interface.

In some embodiments, the plurality of resonant cavities are arranged linearly. The plurality of resonant cavities can be arranged in an inline configuration.

In some embodiments, the signal input interface and signal output interface can be arranged linearly with the plurality of resonant cavities.

In some embodiments, each resonant cavity includes a pair of cavity sections, and the capacitive iris can be positioned between the pair of cavity sections.

In some embodiments, each coupling iris can be an inductive iris.

In some embodiments, each resonant cavity has an outer cavity profile; for each resonant cavity, the corresponding outer cavity profile occupies a corresponding cavity volume; and the cavity volumes can vary amongst the plurality of resonant cavities.

In some embodiments, each resonant cavity has an outer cavity profile; for each resonant cavity, the corresponding outer cavity profile occupies a corresponding cavity volume; and the cavity volumes may be the same for each resonant cavity It will be appreciated by a person skilled in the art that a band-pass filter may include any one or more of the features contained herein and that the features may be used in any particular combination or sub-combination suitable for a band-pass filter and/or filter component.

Other features and advantages of the present application will become apparent from the following detailed description. It should be understood, however, that the detailed description and the specific examples, while indicating embodiments of the application, are given by way of illustration only and the scope of the claims should not be limited by these embodiments, but should be given the broadest interpretation consistent with the description as a whole.

DRAWINGS

For a better understanding of the embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

Figure 1A:
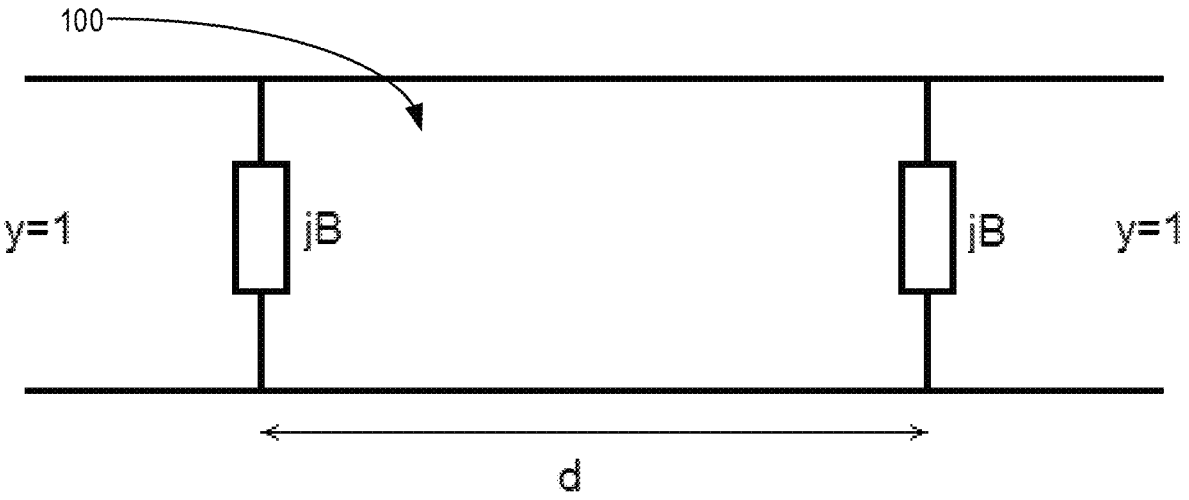
FIG. 1A shows a circuit schematic of an example resonator.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

In the description and drawings herein, reference may be made to a Cartesian co-ordinate system in which the vertical direction, or z-axis, extends in an up and down orientation from bottom to top. The x-axis extends in a first horizontal or width dimension perpendicular to the z-axis, and the y-axis extends cross-wise horizontally relative to the x-axis in a second horizontal or length dimension.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Filters used in long-range communication, such as satellite communication applications, are often required to span a large range of communication channels. For example, input and output filters used with communication satellites may need to permit a wide range of input and output multiplexer channels to pass, while rejecting adjacent reception/transmission channels, harmonics, and interference as well as rejecting spurious frequencies up to the $2^{nd}$ or 3rd harmonic. In many cases, this requires a filter assembly with two, three or sometimes more filter units cascaded in order to provide the required passband and stopband operation.

Although many types of waveguide band-pass filters have been developed, most are not capable of providing continuous broadband rejection of unwanted frequencies for all waveguide modes. Embodiments described herein may enable waveguide band-pass filters that provide broadband rejection of unwanted frequencies for all waveguide modes. Embodiments described herein can provide bandpass filters for wide-band applications with reduced size. This may minimize or avoid the need to cascade a bandpass filter with a lowpass or highpass filter to provide a required level of out-of-band rejection performance.

In embodiments described herein, the filters may be constructed as a reflective (not absorptive) and passive (not active) band-pass filter. The filter components can be constructed as waveguide filters. The filter structure can use waveguides rather than coaxial line, PCB etc. The filter input/outputs, however, can be manufactured using coaxial or PCB drop-in (in addition to waveguide components) if appropriate interfaces are provided.

In embodiments described herein, filters can be configured using a plurality of rectangular waveguide cavities. The rectangular waveguide cavities can define waveguide resonators. As used herein, the term rectangular cavity or cavities includes a predominantly hollow space of a substantially rectangular parallelepiped shape (which may have some intruding or extruding elements). The resonant cavities described herein that are H-shaped and Π-shaped may be considered modified forms of rectangular cavity resonators.

Filters described herein may be considered directly coupled filters in which resonator cavities are sequentially connected to each other by diaphragms (irises).

Alternately or in addition, dual-mode cavities, with additional resonating or non-resonating modes can be used.

As described herein below, filters may be constructed using a plurality of generally H- or Π-shaped resonators. The resonators can be configured with a specified arrangement of resonance frequencies corresponding to different resonance modes. The arrangement of resonance frequencies for the plurality of resonators can be defined to provide an overlap of desired resonances (to define the filter passband) when the resonators are coupled using irises. The arrangement of resonance frequencies for the plurality of resonators can also be defined to provide a mismatch of unwanted (i.e. spurious) resonances (i.e. the frequency responses of unwanted resonances can be defined to vary from resonator to resonator) when the resonators are coupled using irises. Embodiments of the filters described herein can thus be configured to provide a band-pass response for the operational (dominant) waveguide mode and attenuate other (spurious) responses caused by the other (spurious) resonances.

The resonator cavities used in the filters described herein may be loaded with capacitive irises. Adjacent resonator cavities can be coupled by inductive irises. The resonator cavities in the sequence may have varying dimensions.

In many applications, TE20-mode remains the dominant spurious mode in waveguide RF systems. Embodiments described herein may reduce, or remove, the impact of TE20-mode spurious responses while providing an overall reduction of mass, size, insertion loss and cost.

In some embodiments, the bandpass filters (BPFs) described herein may be cascaded with lowpass filters (LPFs) to function as two waveguide filters (BPF+LPF) connected within a single filter assembly unit of about half size of a typical BPF+LPF cascade.

Referring to FIG. 1A, shown therein is a circuit schematic diagram of a resonator 100. In the example of FIG. 1A, resonator 100 represents a single loaded rectangular resonator or resonant cavity (with dimensions a×b). The resonator 100 can be provided by a waveguide section of length d. The waveguide section can be positioned between two identical shunt susceptances jB. The shunt susceptances jB represent inductive irises used to couple resonator 100 to adjacent resonators or other components in a filter. For simplicity, the characteristics of resonator 100 will be described as real susceptance although the value of jB will often be a complex number because of the real thickness of the iris(es) and high order mode scattering. However, those effects may be considered negligible in the context of the discussion that follows.

The dimensions of an individual rectangular resonator 100 can define the resonant frequencies of that resonator 100. When a plurality of resonators 100 are used to provide a filter (such as filter 150 shown in FIG. 1B), the dimensions of the individual resonators 100 can be selected and/or adjusted to define the resonant frequencies of the resonator, and in turn the frequency response of the filter (e.g. passband, stopband etc.).

For example, the dimensions of an unloaded rectangular cavity waveguide resonator 100 may be determined using equation (1):

$$f_{mnl} = \frac{c}{2\pi\sqrt{\mu_r\varepsilon_r}}\sqrt{\left(\frac{m\pi}{a}\right)^2+\left(\frac{n\pi}{b}\right)^2+\left(\frac{l\pi}{d}\right)^2} \tag{1}$$

where c represents the speed of light in free space enclosed by a cavity resonator 100; a, b and d represent the perpendicular dimensions of the cavity resonator 100; indices m, n, 1 represent the number of half wave patterns along the x, y and z dimensions respectively for a particular resonant frequency f; μ is the permeability of the cavity, and £ is the permittivity of the cavity.

Equation (1) defines a relationship between the resonant frequencies f of a rectangular waveguide cavity structure such as the cavity resonators 100 and the dimensions a, b and d of that rectangular waveguide cavity structure. In general, for a rectangular waveguide resonator structure, the resonant frequency of a transverse electric (TE) or transverse magnetic (TM) mode can be uniquely determined by a corresponding resonant wave number.

Alternatively, for a loaded rectangular resonator 100 *nml* resonance can be shown to occur when:

$$\beta_{n,m}d = \left(l-\frac{1}{2}\right)\pi - \operatorname{asin}\left(\frac{B}{\sqrt{4+B^2}}\right), \tag{1a}$$

$$\beta_{n,m} = \sqrt{k^2-\left(\frac{n\pi}{a}\right)^2-\left(\frac{m\pi}{b}\right)^2}, \tag{2}$$

where k represents wavenumber, $\beta_{n,m}$ represents the propagation constant corresponding to the appropriate $TE_{nm}$ or $TM_{nm}$ waveguide mode producing the standing wave resonance of the order l if the resonator cavity is shorted at both ends (e.g. determined from the permeability and permittivity of the cavity), the indices m, n, l represent the number of half wave patterns along the x, y and z dimensions of the resonator respectively for a particular resonant frequency f. The wavenumber k is related to frequency f by $$k = \frac{2\pi}{c} f,$$

where c represents the speed of light in free space enclosed by the resonator 100. The bandwidth of resonance can be expressed as:

$$\Delta\beta_{nm} = \frac{2}{d} \cdot \operatorname{asin}\left(\sqrt{\frac{1 - T^2}{T^2 \cdot B^2\left(1 + \left(\frac{B}{2}\right)^2\right)}}\right). \tag{3}$$

where T represents attenuation level.

For the fundamental $TE_{101}$ resonance the required length of the resonator 100 (using the resonant wavenumber $k_r$ of the specified pass-band) can be determined using equation (4):

$$d = \frac{\pi + \operatorname{atan}\left(\frac{2}{B}\right)}{\sqrt{k_r^2 - \left(\frac{\pi}{a}\right)^2}}. \tag{4}$$

The length d of the resonator 100 in equation (4) is determined using the fundamental resonance mode and the B value defined at the filter pass-band.

Figure 1B:
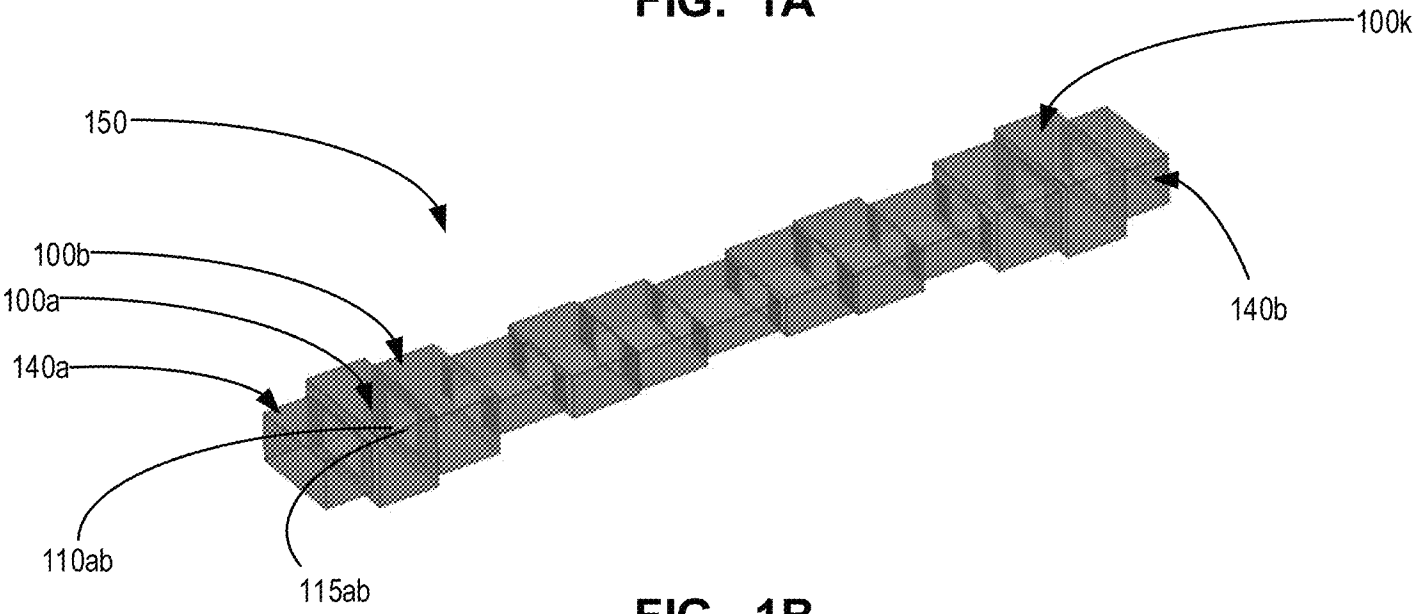
FIG. 1B shows an example of a filter implemented using a plurality of resonators.

When one or more resonators are used to provide a filter, such as resonators 100*a*-100*k* used to provide filter 150 shown in FIG. 1B, the resonant frequencies of the resonators 100 can be selected to define the passbands and stopbands of the filter 150. However, difficulties may be encountered when attempting to construct a wide-band filter using sequential waveguide resonators.

The filter 150 includes an input connection node or input interface 140*a* connected to the first resonator 100*a*. The filter 150 also includes an output connection node or output interface 140*b* connected to the last resonator 100*k*.

Inductive coupling between the spurious resonances of adjacent resonators can increase as the signal frequency increases. Thus, propagation of unwanted signals through the filter may occur when the bandwidths of resonances intersect each other and result in a spurious pass-band.

For example, direct coupling of spurious responses may significantly increase over frequency, at least for the dominant (TE10) waveguide mode. The dominant mode response may then include a second, unwanted, pass-band corresponding to the second-order spurious resonances (TE102). The bandwidth of this TE102 spurious passband can even be larger, and in some cases much larger (e.g. more than twice as large), than the fundamental TE101 bandwidth. As a result, unwanted signals may be permitted to pass through the spurious passband.

In some cases, non-identical resonators may be used (see e.g. resonators 100*a* and 100*b*) to provide a filter 150. For example, resonators 100*a*, 100*b* having the same fundamental frequency but different harmonic frequencies may be used when constructing band-pass filters. This may help reduce the coupling between spurious responses in adjacent resonators. However, spurious passbands may still be present. For example, in wide-band applications the effect of the TE102 spurious passband is likely to still be present, even if non-identical resonators are used.

As used herein, the term wide-band may be used to refer to bandpass filters in which the useful bandwidth (i.e. of the passband) is greater than 10% of the centre frequency (of the passband). As used herein the term narrow-band may refer to bandpass filters where the useful bandwidth is narrower relative to the centre frequency as compared to wide-band filters. In other words, narrow band pass filters may be said to have a selectivity of quality factor Q greater than about 10 while wide band pass filters have a selectivity of quality factor Q less than about 10.

In the example filter 150 shown, variations in the individual cavity dimensions may be limited from resonator 100 to resonator 100. Modifications of the cavity dimensions may result in other (spurious) resonances approaching the fundamental pass-band in wide-band applications. For example, increasing the cavity width may shift the TE201 resonance towards the fundamental pass-band. Increasing cavity height may shift the TE011 resonance towards the fundamental pass-band. Increasing cavity length may shift the TE102 resonance towards the fundamental pass-band. Increasing both the cavity width and cavity height dimensions may shift the TM110 resonance towards the fundamental pass-band.

Spurious nml resonance wavenumbers, which can be used to determine the spurious frequency response, can be determined as:

$$k_{nml} = \sqrt{\left(\frac{n\pi}{a}\right)^2 + \left(\frac{m\pi}{b}\right)^2 + \left(\frac{l\pi + \operatorname{atan}(2/B)}{d}\right)^2}. \tag{5}$$

The bandwidth of the nml resonance $\Delta k_{nmi}$ defined by attenuation magnitude T can then be approximated as $$\Delta k_{nml} \approx 2 \cdot \frac{l\pi + \operatorname{atan}(2/B)}{k_{nml} \cdot d^2} \cdot \operatorname{asin}\left(\sqrt{\frac{1 - T^2}{T^2 \cdot B^2\left(1 + \left(\frac{B}{2}\right)^2\right)}}\right). \tag{6}$$

Equations (5) and (6) can be used to determine the frequency (via the wavenumber) and bandwidth of a spurious resonance. The corresponding B-value for a waveguide mode $TE/TM_{nm}$ can thus be defined at that frequency (the frequency of the spurious response). If the B-value is sufficiently large, the bandwidth of the spurious resonances can be expected to be narrow. This may facilitate scattering the spurious resonances across the stop-band (across the resonators used to form the filter) so that the spurious resonances attenuate one other when non-identical resonators are used to construct the filter. Alternatively, if the B-value is not sufficiently large, the bandwidth of the spurious resonances may be too wide to scatter and attenuate, and as a result undesirable spurious responses can occur.

Inductive irises 115*ab* can be provided between adjacent resonators 100 in waveguide band-pass filters 150. This may help facilitate fundamental pass-band design. However, when inductive irises are used, and the B-value significantly decreases in the frequency range of the second order resonance (TE102), the spurious resonances tend to overlap (e.g. fall within a single resonance bandwidth). As a result, the fundamental waveguide mode (TE10) may tend to be attenuated insignificantly or even be transmitted in these spurious bandwidths. Previous approaches to suppressing higher order resonances in the stopbands have not been applicable to wide-band filters having passbands capable of covering multiple communication frequency channels, such as channels used in a communication satellite, for example.

Embodiments described herein may provide waveguide band-pass filters that are applicable to wide-band applications and reduce or avoid spurious passbands in the upper-stopband of the bandpass filter. In some embodiments, compact waveguide band-pass filters may be provided with a high Q-factor, low insertion loss, high power handling (peak and CW) and broadband spurious-less rejection at least to the second harmonic bandwidth (twice the in-band frequencies).

In general, the Q-factor of a waveguide resonator (such as those used in embodiments described herein) is frequency dependent and may decrease as frequency increases (i.e. the Q-factor may decrease proportionally with the square root of frequency). In embodiments described herein, bandpass filters having a Q-factor much greater than the Q-factor of a theoretically ideal coaxial resonator may be considered to have a high Q-factor. Estimating the Q-factor of an ideal coaxial resonator to be about $7000/\sqrt{f[GHz]}$, a resonator having a Q-factor at least about twice the Q-factor of the ideal coaxial resonator (i.e. at least about $14000/\sqrt{f[GHz]}$) may be considered to be "high Q" in some embodiments.

In embodiments described herein, a bandpass filter can be configured using a plurality of resonators arranged in a sequence. The plurality of resonators can include non-identical resonators. The dimensions of the resonators included in the bandpass filter can be defined so that each resonator has the same fundamental frequency but different harmonic frequencies. As a result, the spurious response of the resonators in the sequence may be scattered over a wider bandwidth.

The resonators used for the bandpass filter can be provided as resonant cavities. Each resonant cavity can include a plurality of cavity sections. For example, each resonant cavity can include a pair of cavity sections.

The cavity sections of a particular resonant cavity can be connected using a capacitive iris. The capacitive iris can be positioned internal to the particular resonator (i.e. as a portion of the overall resonant cavity). The capacitive iris may provide an additional dimension of each cavity resonator that can be selectively configured. This may allow for additional tuning of the passband and stopband response of the filter, this may facilitate providing an improved passband response, and reducing stopband transmission for the filter. This provides further flexibility in configuring the parameters of the filter (and the individual resonators). Providing an added dimension of each resonator that can be selectively configured may allow for desired filter responses to be obtained with fewer resonators.

The capacitive iris within a particular resonant cavity can also be configured to control the TE102 resonance of the resonator. Controlling the configuration of the capacitive iris can thus drive the TE102 spurious response further from the filter pass-band. This may help improve the stopband response of the filter.

Figure 2B:
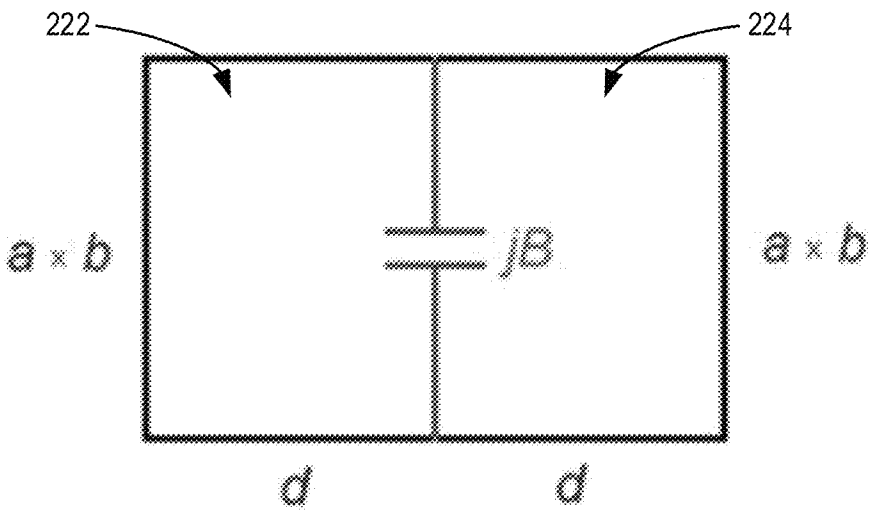
FIG. 2B shows a circuit schematic of the resonant cavity of FIG. 2A.
Figure 2A:
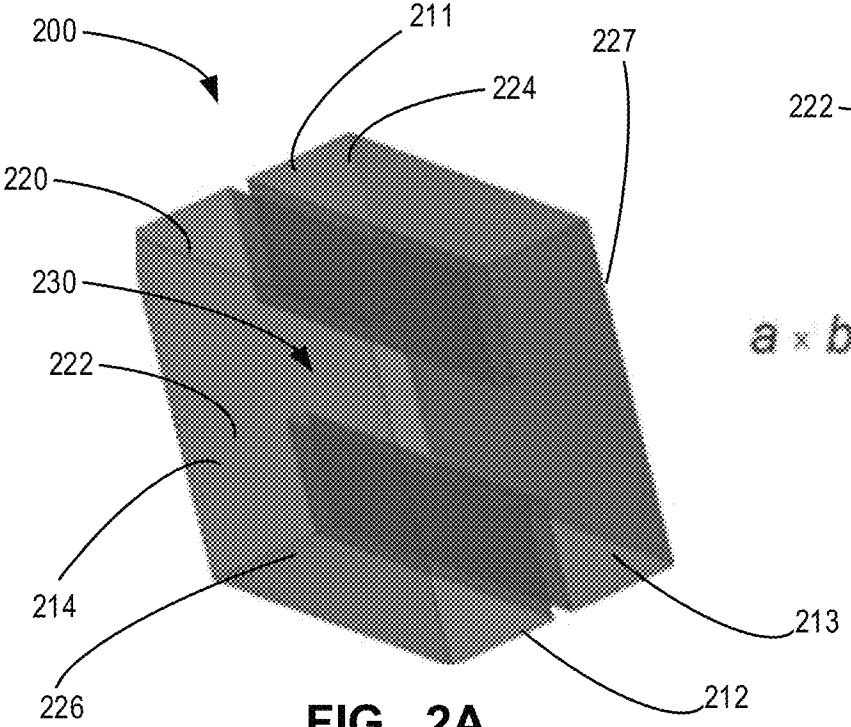
FIG. 2A shows an example of a resonant cavity in accordance with an embodiment.

Referring to FIGS. 2A-2B, shown therein is an example of a resonator 200. The resonator 200 is configured as an internal resonator cavity 220.

As shown in the example of FIG. 2A, the resonant cavity 220 can include a first cavity section 222 and a second cavity section 224. The cavity 220 can extend between a first end face 226 of the first cavity section 222 and a second end face 227 of the second cavity section 224.

As illustrated, the cavity 220 also extends between an upper end 211 and a lower end 212, and between opposed lateral sides 213 and 214. As shown, the resonator cavity 220 may have a generally rectangular outer cavity profile (e.g. an outer profile generally in the shape of a rectangular parallelepiped).

Each cavity section 222, 224 can be defined as a waveguide section having a length d and a cross-sectional area a×b. Each cavity section 222, 224 may itself define a rectangular outer profile (i.e. a rectangular parallelepiped).

As shown, the pair of cavity sections 222 and 224 can be internally connected by a diaphragm or iris 230. The iris 230 can be provided as an opening between the cavity sections 222 and 224. The iris 230 may provide the only direct connection between the cavity sections 222 and 224. That is, cavity sections 222 and 224 may be sealed from one another apart from the iris 230.

In some examples, the dimensions of both cavity sections 222 and 224 will be the same. This may provide a maximal coupling effect for the first resonance TE101 by centering the iris 230 within the cavity 220, as the vertical electric field tends to be stronger there.

Alternately, the dimensions of the cavity sections 222 and 224 may vary. For example, iris 230 may be offset from the center by up to about +/−25% depending on the implementation. The offset selected for a particular implementation may be selected to minimize any impact on the resonance coupling for the first resonance, e.g. through simulations using a finite element method solver for electromagnetic structures (HFSS).

Although the example cavities 220 are illustrated with rectangular outer profiles, other shapes of cavities may also be used. For example, the shape of the cavity sections 222/224 may be generally rectangular with rounded corners (e.g. as shown in FIG. 8C). This may be the case where the cavities 220 are manufactured through a milling process.

Alternately, the cavities may be provided with a generally cylindrical shape.

The iris 230 may provide a capacitive coupling between the cavity sections 222 and 224. The iris 230 can configured to provide a predominantly capacitive response to the dominant or fundamental mode of the resonator 200. The capacitive response of the iris 230 may be defined to extend over the operational bandwidth of a filter in which the resonator 200 is used.

In the example shown, the iris 230 is generally rectangular in shape. Alternately, other shapes may be used for the iris 230. For example, the iris 230 may be asymmetric in some cases. More generally, the iris 230 may be configured with any suitable shape to provide the desired capacitive effect for the particular filter implementation.

In the example illustrated, iris 230 is positioned centrally within the resonator 200, both with respect to the end faces 226/227 and the upper and lower ends 211, 212. Alternately, the iris 230 may be positioned offset from the center of the resonator 200.

In the example illustrated, iris 230 extends across the entire width of the resonator cavity 220 from the first lateral side 213 to the second lateral side 214. The cavity 220 can thus define an H-shaped resonator 200.

The iris 230 can also provide an effective electrical length increase for the resonator 200. This can provide the resonator 200 with an electrical length greater than its physical length. This may allow the length and mass of the resonator 200 to be reduced. Reducing the length of the resonant cavity 220 may also help drive the TE102 spurious response higher.

The dimensions of the iris 230 (including its position within the resonator cavity 220) can provide additional, adjustable dimensions of the resonator 200. This may provide additional flexibility when configuring a filter with a desired signal response.

In the example illustrated, iris 230 in resonator 200 is a symmetric E-plane iris. For the example E-plane iris 230 illustrated, the B-value (normalized to waveguide impedance) can be approximated as:

$$B \approx \propto \cdot \beta \tag{7}$$

where β is the propagation constant corresponding to the a×b waveguide section and a is a frequency independent value that is defined based on the iris geometry.

For the example symmetric E-plane iris 230 (assuming zero thickness), the value α can be defined as:

$$\alpha(b, g) = \frac{1}{\pi} \cdot b \cdot \ln\left(\frac{1}{\sin\left(\frac{\pi g}{2b}\right)}\right). \tag{8}$$

where g represents iris height.

In developing a filter design, the fundamental (quasi-TE101) resonance frequency can be defined initially. In some cases, the height of the iris g or length of the resonator cavity may then be defined. This may provide a constraint on the size of the filter. By pre-defining the height of the iris g or length of the resonator cavity, there are still three remaining dimensions of the resonator 200 that can be adjusted to provide the desired frequency response.

In filter 150, only two dimensions of the resonator 100 can be predefined with the rest defined by resonance conditions—see e.g. equation (5). For example, if the cavity width a and height b are defined, the length d can be determined using equation (5). In filters using the resonator 200, for example, if the width a, height b and the iris height g are defined the length d can be determined using equation (9) below. The particular dimensions that are pre-defined can vary depending on the design preferences in various different implementations.

The resonator half-length at the fundamental resonance frequency can be determined as:

$$d = \frac{1}{\beta_{10}(k_{101}, a)} \operatorname{atan}\left(\frac{1}{\propto(b, g) \cdot \beta_{10}(k_{101}, a)}\right). \tag{9}$$

A similar approach can be applied to determine the quasi-resonance responses. Using the half-length d determined from equation (9), the spurious response frequency for wavenumber $k_{201}$ can be determined according to:

$$\beta_{20}(k_{201}, a) \cdot d = \operatorname{atan}\left(\frac{1}{\propto(b, g) \cdot \beta_{20}(k_{201}, a)}\right) \tag{10}$$

In the example illustrated, the ∝-value is the same for the both resonances due to the E-plane uniformity of the iris 230. The remaining spurious responses (quasi-TE102 and TM110) occur in the non-loaded rectangular resonator 200 since the iris 230 does not significantly distort the electrical field of the original mode. Accordingly, these spurious response frequencies (quasi-TE102 and TM110) can be approximated as:

$$k_{102} = \sqrt{\left(\frac{\pi}{a}\right)^2 + \left(\frac{\pi}{d}\right)^2}, \tag{11}$$

$$k_{110} = \sqrt{\left(\frac{\pi}{a}\right)^2 + \left(\frac{\pi}{b}\right)^2}. \tag{12}$$

By increasing capacitive loading (reducing the g/b ratio in this analysis), the length of the resonator cavity 220 can be reduced (see e.g. equation (9)), while simultaneously increasing the quasi-TE102 resonance frequency (see e.g. equation (11)). This can significantly improve or resolve poor attenuation of the dominant mode over a wide frequency range of the stopband. The other spurious resonances (TE201, TM110 and TE011) can be scattered over the stop-band since the first two resonances (TE201 and TM110) are less coupled and the TE011 resonance frequency increases due to inductive electrical length reduction. TE011 resonance frequency position can be strongly dependent on the coupling and may be approximated as:

$$\sqrt{\left(\frac{\pi}{b}\right)^2 + \left(\frac{\pi}{2d}\right)^2} < k_{011} < \sqrt{\left(\frac{\pi}{b}\right)^2 + \left(\frac{\pi}{d}\right)^2} \tag{13}$$

The resonant response of the resonators 200 can be controlled by adjusting one or more of the dimensions of the resonator. The dimensions of each resonator 200 that are adjusted can include the cavity dimensions (a, b, d) and/or the dimensions of the iris (e.g. iris height g). For example, as illustrated by equation (11), the a dimension and/or the d dimension of the resonator 200 can be adjusted to modify the TE102 mode response. As illustrated by equations (9) and (10), the iris height g can be adjusted to modify the TE101 and TE201 mode responses. Alternately or in addition, the dimensions of each resonator 200 that are adjusted may include other dimensions such as the capacitive iris thickness, the offset of the capacitive, and dimensions of the coupling irises.

Figure 3:
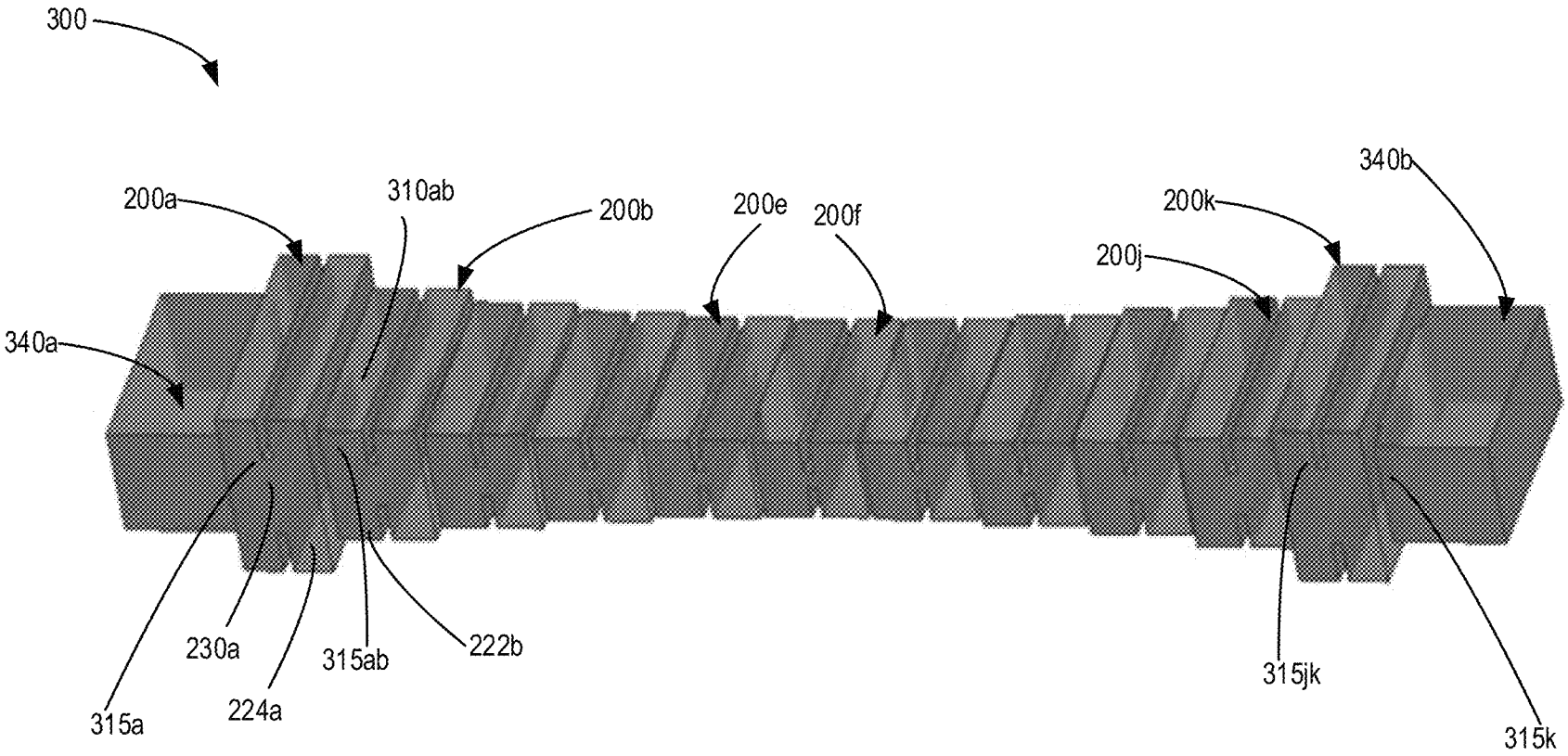
FIG. 3 illustrates an example bandpass filter that includes a plurality of resonant cavities in accordance with an embodiment.

Referring to FIG. 3, shown therein is an example of a filter 300. Filter 300 is an example of a waveguide bandpass filter that may be configured to provide a passband that can extend across the entire C-band communications downlink range (e.g. communications in the range of about 3.4 GHz to about 4.2 GHz). This may allow the filter to pass signals across the entire frequency range of a satellite downlink.

As one example, filter 300 may be implemented using WR-229 waveguide resonant cavities. In other embodiments, depending on the desired passband of the filter, different sizes of waveguides may be used. The size of the waveguide may be selected based on the desired response of the filter, such as the operational frequency range of a given implementation.

In the example shown in FIG. 3, the filter 300 includes a plurality of resonators 200*a*-200*k*. The resonators 200*a*-200*k* are arranged in a sequence from a first or input resonator 200*a* to a last or output resonator 200*k*. Each resonator 200 is positioned adjacent to at least one other resonator 200 in the sequence.

The resonators at either end of the resonator sequence (i.e. first resonator 200*a* and last resonator 200*k*) can each be coupled to a corresponding external interface 340.

The input resonator 200*a* can be coupled to a signal input interface. For example, an inductive iris may be provided coupling the input resonator 200*a* to the signal input interface 340*a*. As illustrated, the signal input interface 340*a* may be connected to only the input resonator 200*a*.

The output resonator 200*k* can be coupled to a signal output interface 340*b*. For example, an inductive iris may be provided coupling the output resonator 200*k* to the signal output interface 340*b*. As illustrated, the signal output interface 340*b* may be connected to only the output resonator 200*k*.

In some examples, the output resonator 200k may be coupled to one or more downstream resonators. For example, the output resonator 200k may be coupled to the input of a cascaded resonator, as in the example of filter 800 shown in FIGS. 8A-8C.

The plurality of resonators 200*a*-200*k* in filter 300 can be arranged in a linear sequence. As shown, the signal input interface 340*a* may be aligned with the linear sequence of resonators 200. Alternately or in addition, the signal output interface 340*b* may be aligned with the sequence of resonators 200. This may provide a substantially linear direction of signal propagation from the signal input interface 340*a* to signal output interface 340*b* (and/or to a downstream resonator).

Filter 300 illustrates an example inline configuration of the resonators 200. The inline configuration of resonators 200 in filter 300 may allow filter 300 to reduce the overall filter width and/or height. This may also simplify the manufacturing and tuning of filter 300.

Alternately, the resonators may be arranged in a folded configuration. This may help reduce the overall length of the bandpass filter. A folded bandpass filter can be configured with the same resonant frequencies and couplings as a corresponding inline configuration.

Optionally, cross-coupling between non-adjacent resonators may be provided in a folded configuration. This may enable elliptical filter functions and/or group delay equalizations to be provided by the folded filter.

Returning to the example filter 300 illustrated, the resonators 200 can be coupled to the adjacent resonators in the sequence by a direct coupling 310*ab*. In the example illustrated, the coupling 310*ab* can be provided as an iris 315*ab* between the second cavity section 224*a* of resonator 200*a* and the first cavity section 222*b* of the adjacent resonator 200*b*. In the example illustrated in FIG. 3, each of the resonators 200*a*-200*k* include a pair of resonant cavities that are internally coupled by a capacitive iris 230.

As illustrated in FIG. 3, each cavity resonator 200 can include one internal capacitive iris 315. Each cavity resonator 200 can also be connected to two inductive irises that provide coupling to adjacent resonators and/or signal interfaces. For instance, an input cavity resonator 200*a* can be connected to a first inductive iris 315*a* coupling the input cavity resonator 200*a* to a signal input interface 340*a*. The input cavity resonator 200*a* can also be connected to a second inductive iris 315*ab* coupling the input cavity resonator 200*a* to an adjacent resonator 200*b*.

Each intermediate cavity resonator 200*b*-200*j* can be connected to a first conductive iris 315 coupling that intermediate cavity resonator to a first adjacent cavity resonator and to a second inductive iris 315 coupling that intermediate cavity resonator to a second adjacent resonator.

An output cavity resonator 200*k* can be connected to a first inductive iris 315*jk* coupling the output cavity resonator 200*k* to an adjacent resonator 200*j*. The output cavity resonator 200*k* can also be connected to a second inductive iris 315*k* coupling the output cavity resonator 200*k* to a signal output interface 340*b*.

The inductive irises 315 in filter 300 can be aligned along a longitudinal iris axis. This may simplify the design and manufacture of filter 300. This may also provide greater coupling between the resonators 200, which may facilitate broadband filter operation.

Alternately, the irises 315 may be offset from one another, so long as the desired coupling is provided between adjacent resonators 200. In some examples, the irises 315 may be non-uniaxial, for instance where a folded configuration is used with side, top or bottom coupling irises 315.

The dimensions of the individual irises 315 can be determined based on the coupling required between resonators 200 (e.g. as determined from an idealized filter network). The required coupling can be used to determine the dimensions of iris 315 such as the window width, height, thickness and position (offset).

In some examples, the sizes of the irises 315 can vary throughout the filter 300. Alternately, the sizes of the irises 315 may not vary throughout the filter 300. Varying the sizes of the irises 315 may help scatter the spurious responses of the resonators 200.

In the example illustrated, the resonators 200 in the middle of the resonator sequence may require less coupling as compared to the resonators closer to the beginning or end of the sequence. As a result, the irises 315 between the resonators in the middle of the sequence may be narrower while those between outer resonators may be wider.

As explained above, by adjusting the dimensions of the individual resonators 200 while maintaining the same fundamental resonant frequencies, a filter can be constructed having a desired bandpass response. As shown in the example of FIG. 3, the dimensions a, b, g of the resonators 200 used in filter 300 vary across the sequence of resonators, while still providing the same fundamental frequency response. Alternately or in addition, other dimensions of resonators 200 may vary across the sequence of resonators.

In the example illustrated in FIG. 3, the dimensions a, b, g of the resonant cavities 200 taper from outer resonators 200 to the inner resonators 200. That is, the largest dimensions can be provided in resonators 200*a* and 200*k* at either end of the sequence and the smallest dimensions can be provided in the middle resonators 200*e* and 200*f*. In the example of filter 300, the dimensions a, b, g of resonators 200 have been tapered using a sine function, without any special optimization of distribution of the spurious resonances. The specific dimensions of the resonators 200 that may be adjusted between resonators can vary depending on the frequency response requirements of a given application.

The inventors synthesized an implementation of filter 300 configured with a passband that extends between 3.6 GHz-4.2 GHz. The frequency response of the filter 300 was then simulated for the dominant TE10 mode (see e.g. FIG. 4), as well as a number of additional waveguide modes (see e.g. FIG. 5).

Figure 4:
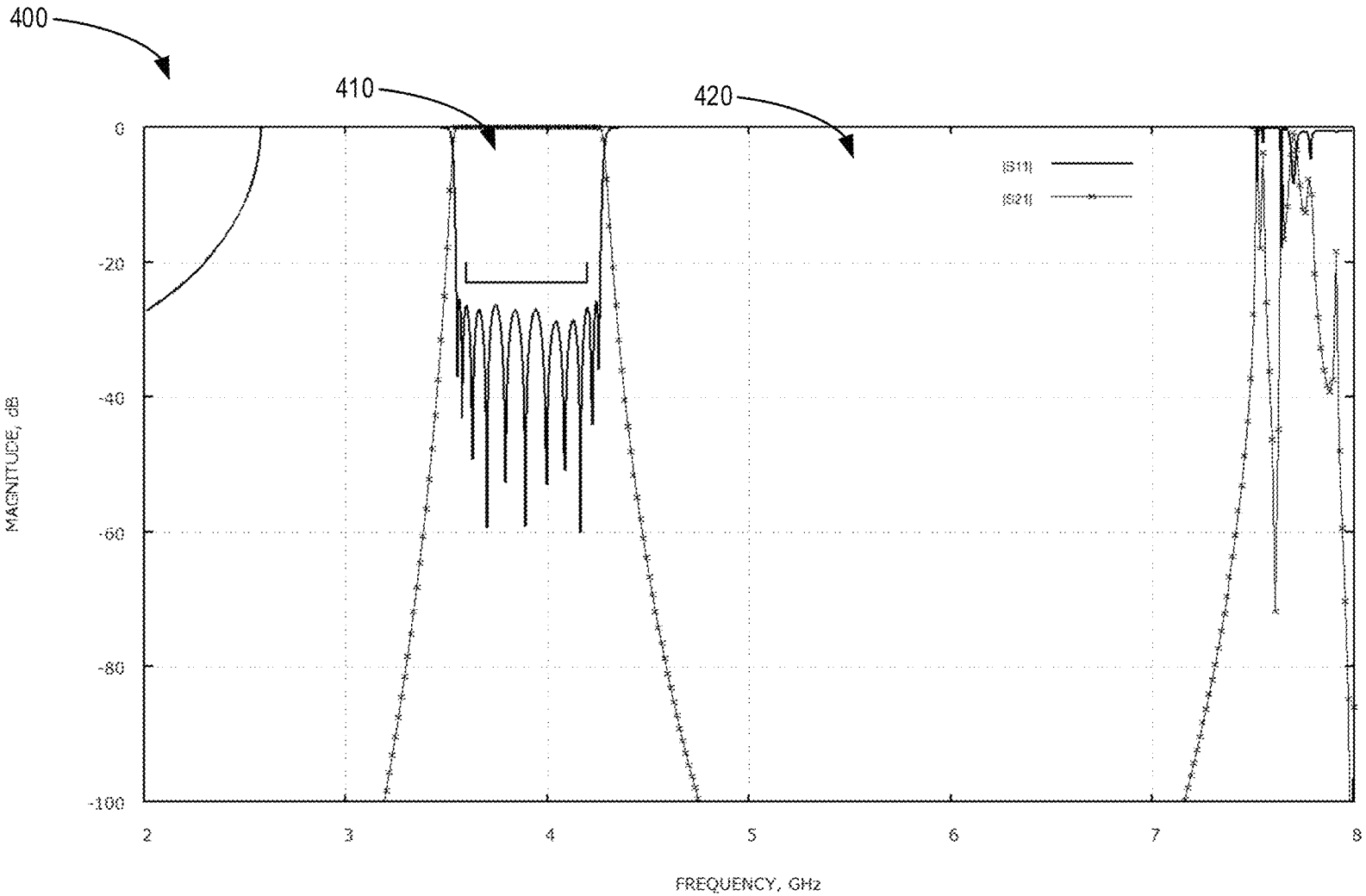
FIG. 4 shows a plot illustrating the frequency response for the dominant TE10 mode of an example implementation of the bandpass filter of FIG. 3.

FIG. 4 shows a plot 400 illustrating the simulation results of dominant TE10 mode frequency response for an implementation of filter 300. Plot 400 illustrates the passband 410 positioned at about 3.6 GHz-4.2 GHz. As illustrated in plot 400, the passband 410 has been design to cover the entire range of a C-band communication satellite downlink, which is quite wide (e.g. 15-21%). Other configurations may also be used, for instance other satellite up/down-links may be relatively narrower while still being wideband in percentage (10-15%).

As shown in plot 400, the upper stop-band 420 extends far above the upper end of the passband, to more than 7 GHz. In many existing filters, the operational attenuation bandwidth by 40-50 dB extends no further than 25% from the central frequency. As shown in plot 400, the upper stop-band of filter 300 extends almost 200% from the central frequency while still providing a broad passband.

Figure 5:
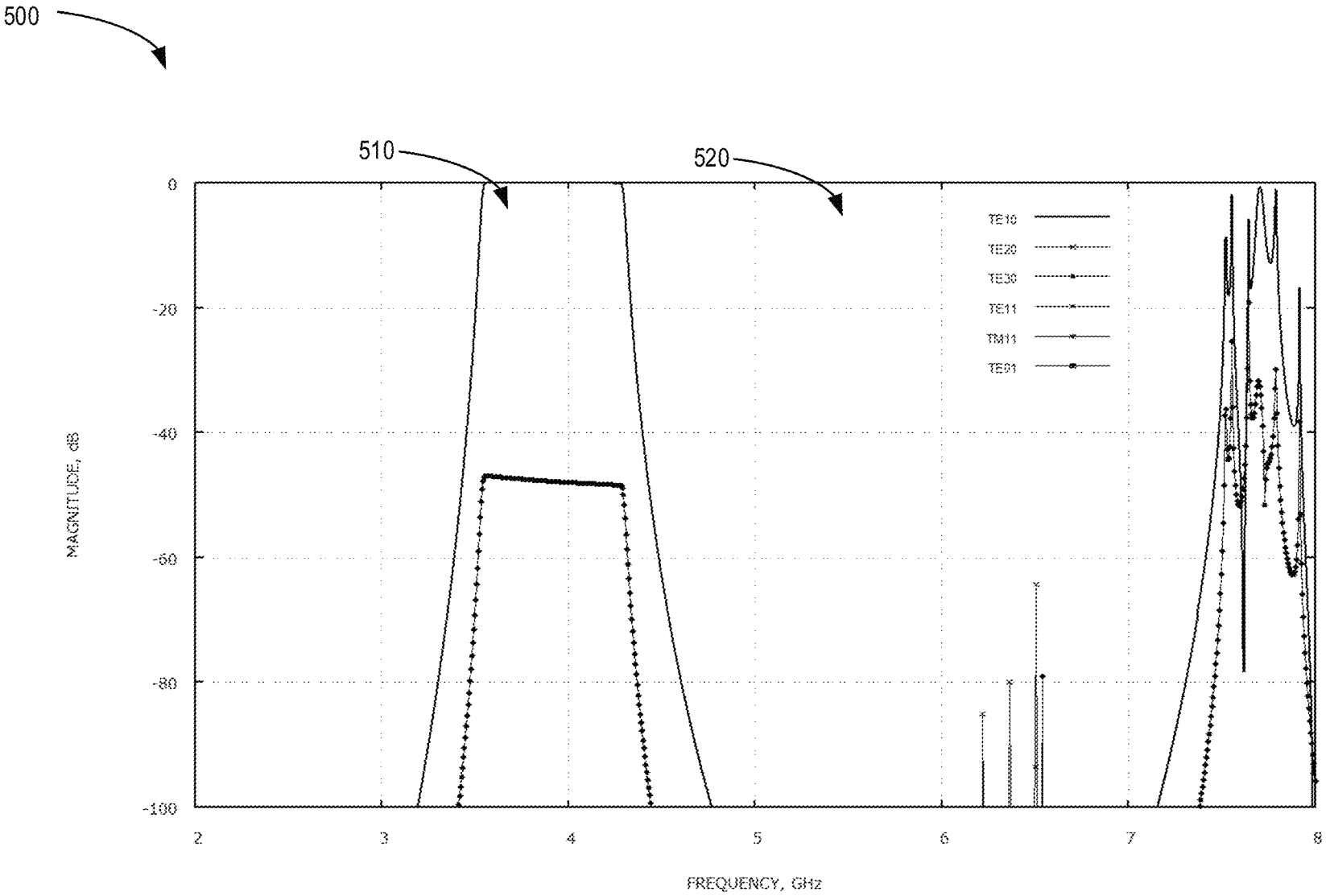
FIG. 5 shows a plot illustrating the frequency response across several transmission modes of an example implementation of the bandpass filter of FIG. 3.

FIG. 5 shows a plot 500 illustrating the simulation results of the frequency response for an implementation of filter 300 across several different waveguide modes. Plot 500 illustrates the passband 510 positioned at about 3.6 GHz-4.2 GHz and shows good transmission across the passband 510. As with plot 400, the upper stop-band 520 of filter 300 extends far above the upper end of the passband, to more than 7 GHz. As shown in plot 500, there is minimal spurious transmission within this upper stop-band 520.

As shown above, the filter 300 described herein can provide improved performance in the far high stop-band. As shown, the filter 300 may be implemented using non-identical H-shaped resonators 200 having different arrangements of spurious responses to frequency (i.e. the individual resonators have their spurious responses distributed differently across frequencies above the passband). Alternately, other shapes of resonant cavities, such as Π-shaped resonators 250 may be used to provide a filter 600 with improved stop-band performance (see e.g. FIG. 6).

These resonators 200/250 may be integrated into another coupling scheme performing near-band or far-band attenuation poles and simultaneously perform a wide spurious-free stop-band. Non-resonating node coupling can be provided in the end cavities using, for example, TE101 and TM110 bypass coupling. This may result in two transmission poles in the upper near-band.

Figure 6:
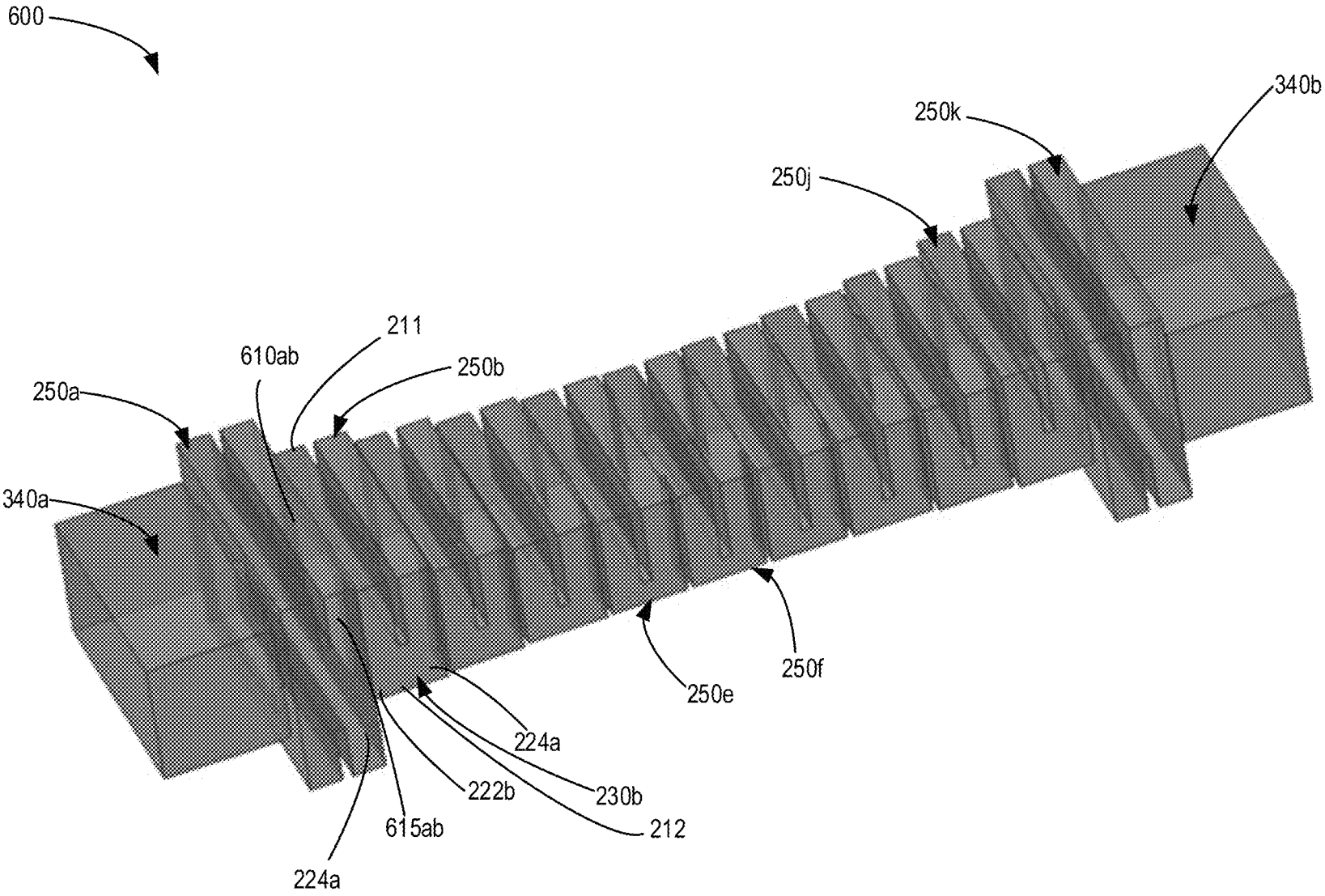
FIG. 6 illustrates another example filter that includes a plurality of resonant cavities in accordance with an embodiment.

Referring to FIG. 6, shown therein is an example of a filter 600. Filter 600 is similar to filter 300 in that the filter 600 includes a plurality of resonators 250 arranged in a sequence from resonator 200*a* to resonator 200*k*. The configuration and arrangement of the resonators 250 in filter 600 is generally similar to resonators 200 in filter 300, except that the intermediate resonators 250*b*-250*j* have a different shape as compared to the intermediate resonators 200*b*-200*j* in filter 300. The end resonators 250*a* and 250*k* correspond generally to end resonators 200*a* and 200*k* of filter 300.

In filter 600, each of the adjacent resonators 250 are provided with a direct coupling 610, in this case an iris 615, between the second cavity section 224 of a first resonator and the first cavity section 222 of a second resonator (see e.g. coupling 610*ab* between resonators 200*a* and 250*b* that includes an iris 615*ab* between cavity sections 224*a* and 222*b*).

As with filter 300, each of the resonators 200/250 include a pair of cavity sections that are internally coupled using a conductive iris 230. However, in filter 600 the plurality of resonators includes intermediate resonators 250*b*-250*j* that are vertically asymmetric. As shown with reference to resonator 250*b*, the resonators 250 includes a pair of cavity sections including a first cavity section 222*b* and a second cavity section 224*b*. The first cavity section 222*b* and second cavity section 224*b* are coupled by a capacitive iris 230*b*. The capacitive iris 230*b* is positioned internally within the resonant cavity 250*b*.

The cavity sections 222*b* and 224*b* extend between the lower end 212 and the upper end 211 of resonant cavity 250*b*. As shown, the capacitive iris 230*b* is positioned at the lower end 212 of the resonator 250*b*. Thus, the cavity sections 222/224 are vertically offset from the capacitive iris 230, as compared to the central positioning in resonators 200.

As shown, end resonators 250*a* and 250*k* can be offset from the remaining resonators 250*b*-250*j*. This configuration may result in transmission zeros by providing non-resonating quasi TM110 nodes. Each end cavity 250*a* and 250*k* may provide one transmission zero. Additionally or alternatively, offset cavities such as cavities 250*a* and 250*k*, may be positioned within the sequence of intermediate resonators 250*b*-250*j*. The specific arrangement of resonators 200/250 in a given filter can be determined based on the desired frequency response.

As with filter 300, the dimensions a, b, g of the resonators 250 used in filter 600 can vary across the sequence of resonators 250*a*-250*k*. In the example illustrated, the dimensions a, b, g of the resonant cavities 250 taper from outer resonators 200 to the inner resonators 200. That is, the largest dimensions can be provided in resonators 250*a* and 250*k* at either end of the sequence and the smallest dimensions can be provided in the middle resonators 250*e* and 250*f*. In filter 600, the dimensions a, b, g of resonators 250 have been tapered using a sine function, without any special optimization of distribution of the spurious resonances. The specific dimensions of the resonators 250 that may be adjusted between resonators can vary depending on the frequency response requirements of a given application.

Figure 7:
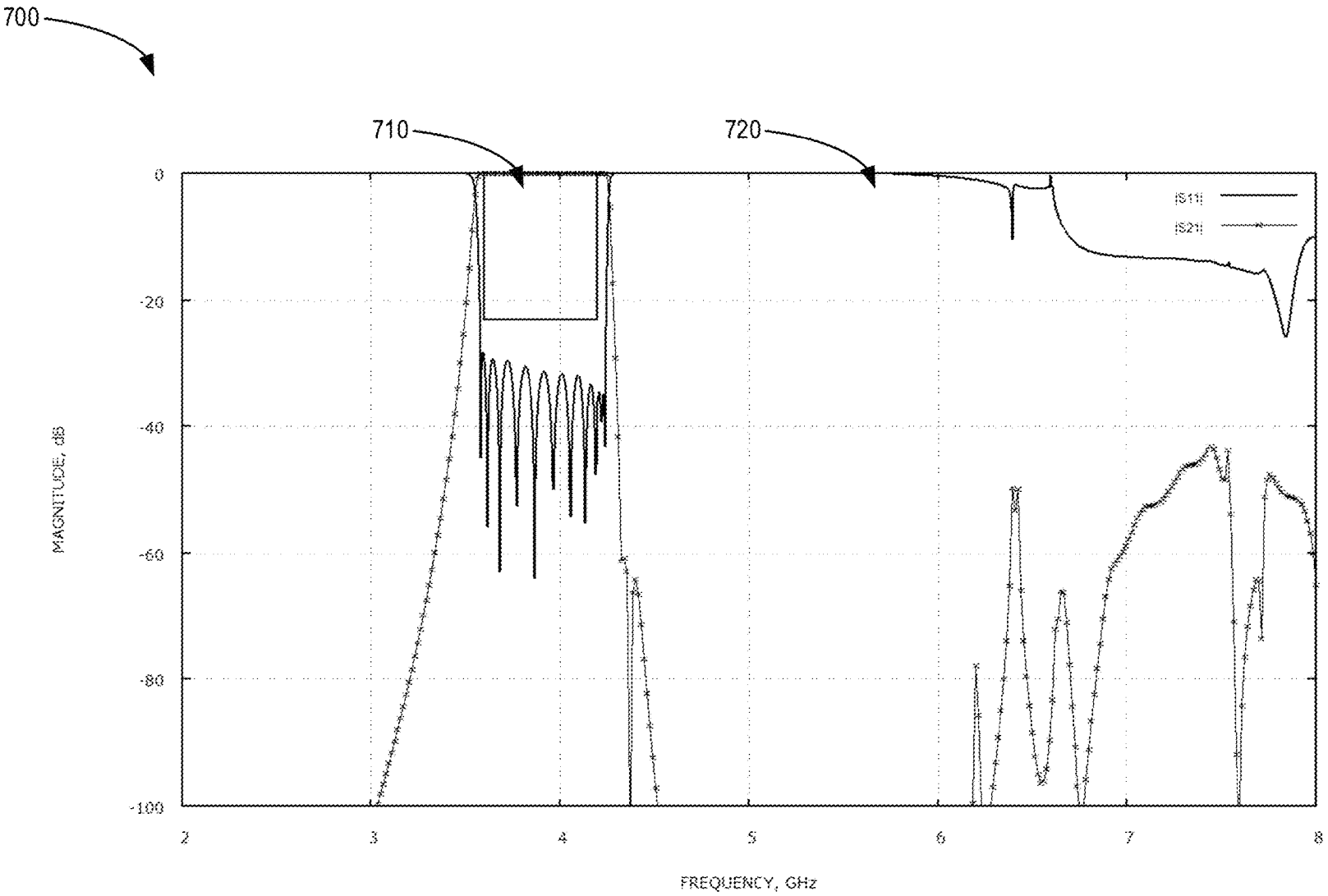
FIG. 7 shows a plot illustrating the frequency response for the dominant TE10 mode of an example implementation of the bandpass filter of FIG. 6.

FIG. 7 shows a plot 700 illustrating the simulation results of the frequency response for an implementation of filter 600 across several different waveguide modes. Plot 700 illustrates the passband 710 positioned at about 3.6 GHz-4.2 GHz and shows good transmission across the passband 710. As with filter 300, the upper stop-band 720 of filter 600 extends far above the upper end of the passband, to more than 6 GHz in this case. As shown in plot 700, there is minimal spurious transmission up to above 7 GHz within the upper stop-band 720 of filter 600.

In the examples illustrated herein, an E-plane iris is positioned internally within resonators 200/250 to couple a pair of rectangular resonator cavity sections. Inserting an E-plane iris into a rectangular cavity resonator such as resonators 200/250 does not significantly impact the TM110/TM120-mode resonance response of the resonator. This allows the resonators 200/250 to be used with similar coupling configurations as existing rectangular cavity resonators (e.g. dual-mode, non-resonating node, etc.). Additionally, attenuation poles can be achieved through corresponding cross-coupling or bypass coupling between resonators.

The filters 300/600 described herein above may provide desired filter responses with a more compact size than many existing filter assemblies. This capability, along with the improved spurious mode suppression facilitates cascading the bandpass filter 300/600 with other filters (e.g. a corrugated low-pass filter or other suitable low-pass filter) to ensure significant attenuation of all waveguide modes over a wider bandwidth. Even with a cascaded filter assembly, the overall filter size and cost may still be reduced while provided improved rejection and loss performance.

Because the bandpass filters 300/600 can be configured to efficiently suppress TE20-mode propagation (which is difficult to reject with a single corrugated LPF), the performance of the overall cascaded filter assembly can be improved. Additionally, since the bandpass filters 300/600 may provide higher Q values, the insertion loss into the cascade may be reduced. This may allow smaller LPF cavities to be used for the low-pass portion of the filter assembly. The E-plane layout of the filters 300/600 may also facilitate integration of the bandpass and lowpass filters into a single, easily machinable structure to facilitate manufacturing.

Figure 8A:
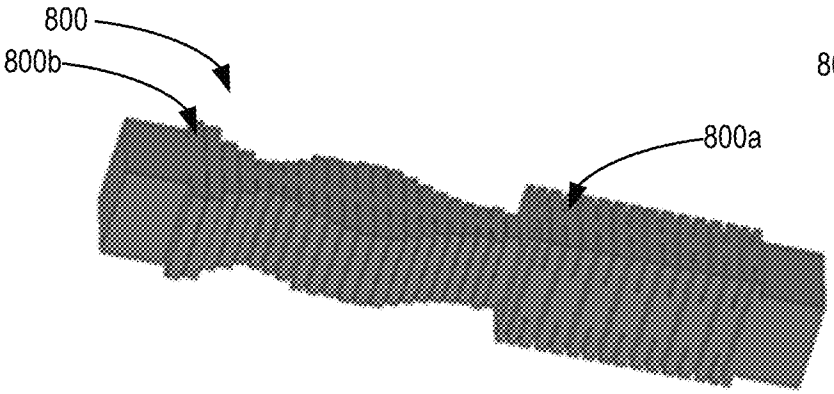
FIG. 8A illustrates a perspective view of another example filter that includes a plurality of resonant cavities in accordance with an embodiment.
Figure 8B:
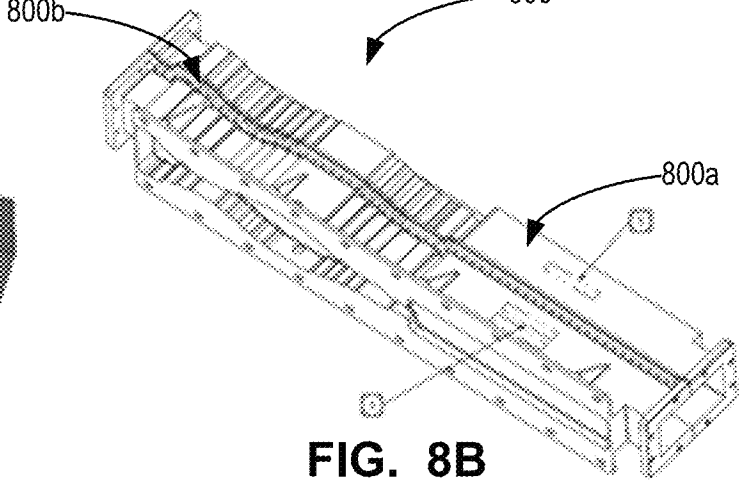
FIG. 8B illustrates another perspective view of the example filter of FIG. 8A.
Figure 8C:
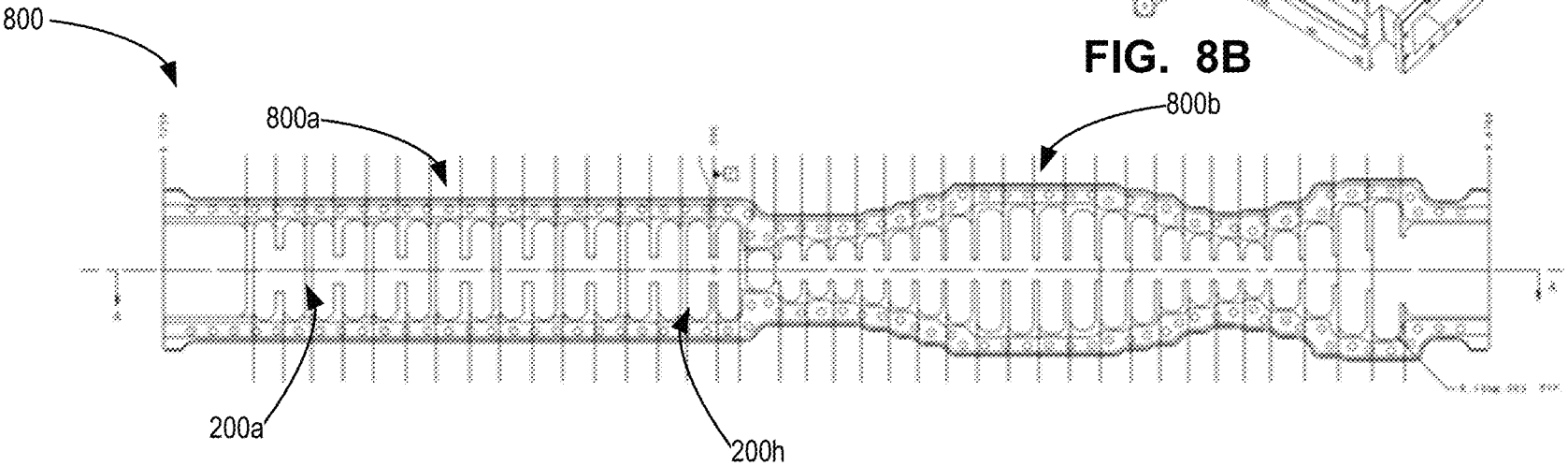
FIG. 8C illustrates a sectional view of the example filter of FIG. 8A.

Referring to FIGS. 8A-8B, shown therein is an example filter assembly 800. The example filter assembly 800 includes a bandpass filter 800*a* cascaded with a low-pass filter 800*b*. As shown in FIGS. 8A-8C, the filter 800 may provide a cascaded bandpass filter 800*a* and low-pass filter 800*b* within a single combined structure. This may facilitate manufacturing, by allowing the bandpass filter 800*a* and low-pass filter 800*b* to be machined together. The filter assembly 800 may thus provide an integrated bandpass and lowpass filter assembly.

In the example illustrated, the bandpass filter section 800*a* includes a plurality of resonators 200*a*-200*h*. The resonators used to provide the bandpass filter section 800*a* are H-shaped similar to filter 300. Unlike filter 300 however, in bandpass filter section 800*a* the outer dimensions of the cavities of resonators 200*a*-200*h* are all the same. The bandpass filter section 800*a* may also use larger resonators providing a higher Q-factor.

As with filters 300 and 600 described herein above, the resonators 200*a*-200*h* can be configured with the same fundamental resonance response and different spurious responses. For example, the dimensions of the irises and/or resonant cavities may be adjusted to provide varying spurious responses across the resonators 200*a*-200*h*.

In the cascaded filter 800, the low-pass filter section 800*b* may be configured to prevent propagation of cross-polarized waveguide modes (TE01 and TM11). Accordingly, the excitation of the corresponding resonances (TE011 and TM110) can be minimal. Optionally, the requirements to scatter those resonances (e.g. equations 12 and 13) may thus be removed or ignored.

In some examples, the bandpass filter section 800*a* may be configured to manage the remaining spurious responses, i.e. TE102 and TE201, which are not removed by the low-pass filter section 800*b*. The dimensions of the resonators 200 in bandpass filter section 800*a* can be selected to manage these remaining spurious responses using equations (9)-(11). For instance, the resonance responses of the resonators 200 can be defined by adjusting the iris height g while maintaining a constant.

In the example illustrated in FIGS. 8A-8C, the cavity width a and height b of the resonators 200*a*-200*h* in filter section 800*a* do not vary. However, the dimensions of the resonators 200, such as iris height g and cavity length d, can vary amongst the 200*a*-200*h*. The spurious responses of the resonators 200*a*-200*h* may thus be scattered by varying the dimensions of the resonators 200 in filter section 800*a*.

In the cascaded filter 800, the low-pass filter section 800*b* can be configured to reject a number of spurious response modes of the resonators 200*a*-200*h*. Accordingly, the number of spurious responses that need to be scattered by bandpass filter section 800*a* may be reduced.

For example, filter section 800*a* may be configured to scatter the responses of the TE201 and TE102 resonance modes. The TE201 resonances may couple the TE20 waveguide mode, which is a high risk spurious mode able to pass through the LPF section 800*b*. To control this mode, the TE201 responses of the resonators 200*a*-200*h* can be scattered by varying the dimensions of the resonators 200*a*-200*h*.

The dimensions of the resonators 200*a*-200*h* can also be defined to control the TE102 resonance mode. This may enable filter 800 to provide a broadband and symmetric filter response.

FIGS. 8B and 8C illustrate a model of the cascaded filter that was implemented by the inventors. The implementation of filter 800 was configured with a passband for a 3.4-4.2 GHz C-band downlink (21% relative bandwidth). The filter 800 was designed using multi-modal design software based on mode-matching and adapted to milling fabrication (having radii at corners) to facilitate cost reduction.

Experimental Results

The inventors designed and manufactured three different waveguide filter prototypes for a common C-band communication requirement. In particular, each filter was designed to provide a passband at 3.6-4.2 GHz and to include 11-pole Chebyshev filter function. The filter prototypes were designed using WR-229 waveguides. The frequency response of each prototype was tested to determine how an implementation of the embodiments described herein compares to existing filter specifications.

A first comparator filter prototype was designed as a conventional iris filter in accordance with the description provided in U.S. Pat. No. 2,585,563 of W. D. Lewis, L. Silver, W. Mumford, entitled "Wave Filter", the entirety of which is incorporated herein by reference. This filter prototype is based on a straight waveguide section with H-plane irises forming resonator cavities directly coupled to each other. The length of each resonator is defined from the resonance condition (is close to a selected number of wave halves in the channel waveguide). Thus, the resonator lengths are about the same as well. As a result, the positions of spurious resonances are also close to each other, and the filter does not provide much if any suppression of spurious waveguide modes.

A second comparator filter prototype was designed using non-identical irises in accordance with the description provided in U.S. Pat. No. 3,153,208 of H. J. RIELET, entitled "Waveguide Filter Having Nonidentical, Sections Resonant at Same Fundamental Frequency And Different Harmonic Frequencies", the entirety of which is incorporated herein by reference. This filter uses different cross-section dimensions for the resonators, however the length of each resonator cannot be controlled as it is directly defined from the resonance conditions. This disadvantage leads to a lack of control over the modes defined by the electrical length of the resonator. For example, if the filter operates on TE101 resonances, the positions of the TE102 resonances are also defined from the design conditions. Moreover, the inductive coupling of the irises between individual resonators has a tendency to increase the resulting reduction of upper stopband attenuation and bandwidth.

The inventors simulated the comparator filter prototypes and an implementation of the filter 300 described herein above using a finite element method solver for electromagnetic structures (HFSS) from Ansys®. The Q-factors for each filter were then extracted from the simulation results. The performance parameters that resulted from the simulation are summarized in Table 1 below:

TABLE 1

| Simulation Results | | | | |
|---|---|---|---|---|
| Unit | Q-factor (1) | 50 dB low stop-band width, MHz | 50 dB High stop-band width, MHz | Length, inch (2) |
| First Comparator Filter | 14000 | 3400 | 760 | 18.1 |
| Second Comparator Filter | 11500 | 3425 | 288 | 16.6 |
| Filter 300 | 9000 | 3415 | 3060 | 11.6 |

Notes:
(1) Q-factor is defined from insertion loss obtained from HFSS
(2) Length is taken from the first to the last iris (omitting additional interface nodes).

As shown in Table 1, each filter has a similar low stop-band width (i.e. the bandwidth from DC (0 MHz) to the left roll-off of the passband). However, the example filter 300 has a much larger high stop-band width (i.e. the bandwidth from the upper roll-off of the passband to the first spurious band) in comparison with the comparator filters. The experimental results indicate a significantly stronger upper stop-band in filter 300, which in the results shown above is four times wider than the comparator filters. The filter 300 thus eliminates uplink frequencies. Additionally, the design of filter 300 is much smaller and can provide a lighter mechanical realization contrasted with the comparator filters. These advantages may be particularly significant for filter applications in space, for instance in satellite applications. Although the experiment was implemented for a C-band satellite applications, the advantages noted above may be expected to be transferable to other satellite bands and many ground applications as well.

Figure 9A:
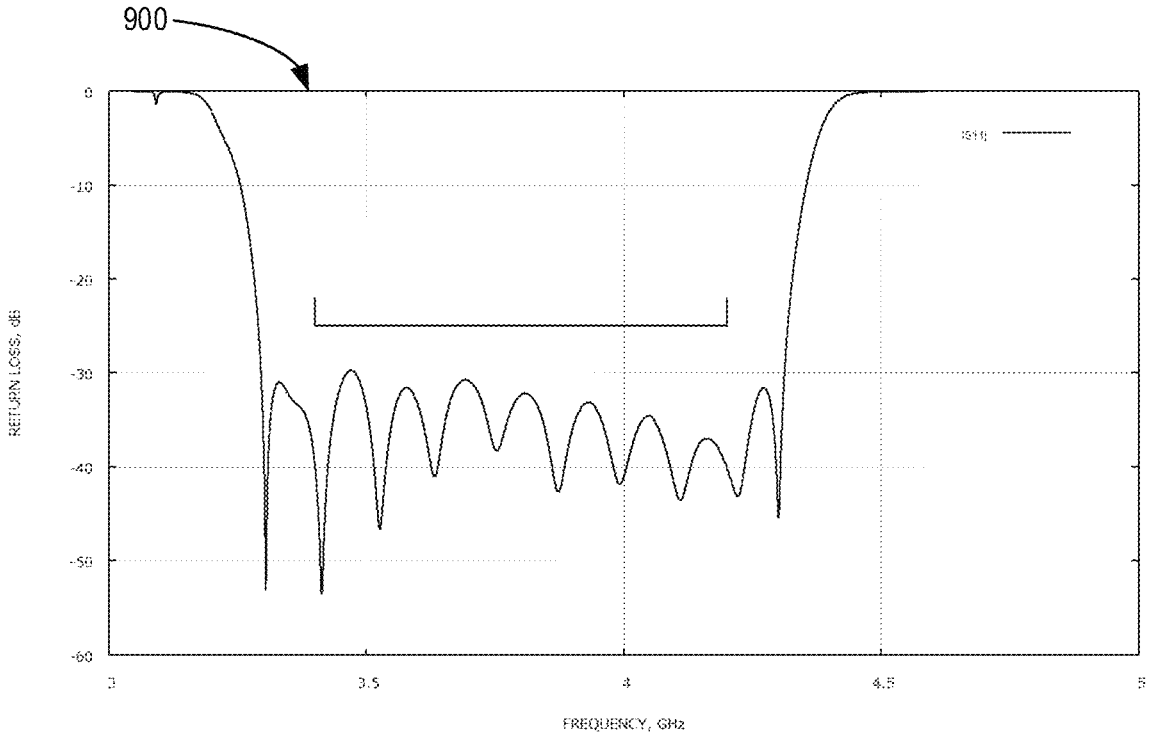
FIG. 9A shows a plot illustrating return loss over a range of frequencies including the passband frequency range for an example implementation of the filter of FIGS. 8A-8C.

FIG. 9A illustrates a plot 900 of return loss over a range of frequencies including the passband frequency range for an example implementation of the filter 800.

Figure 9B:
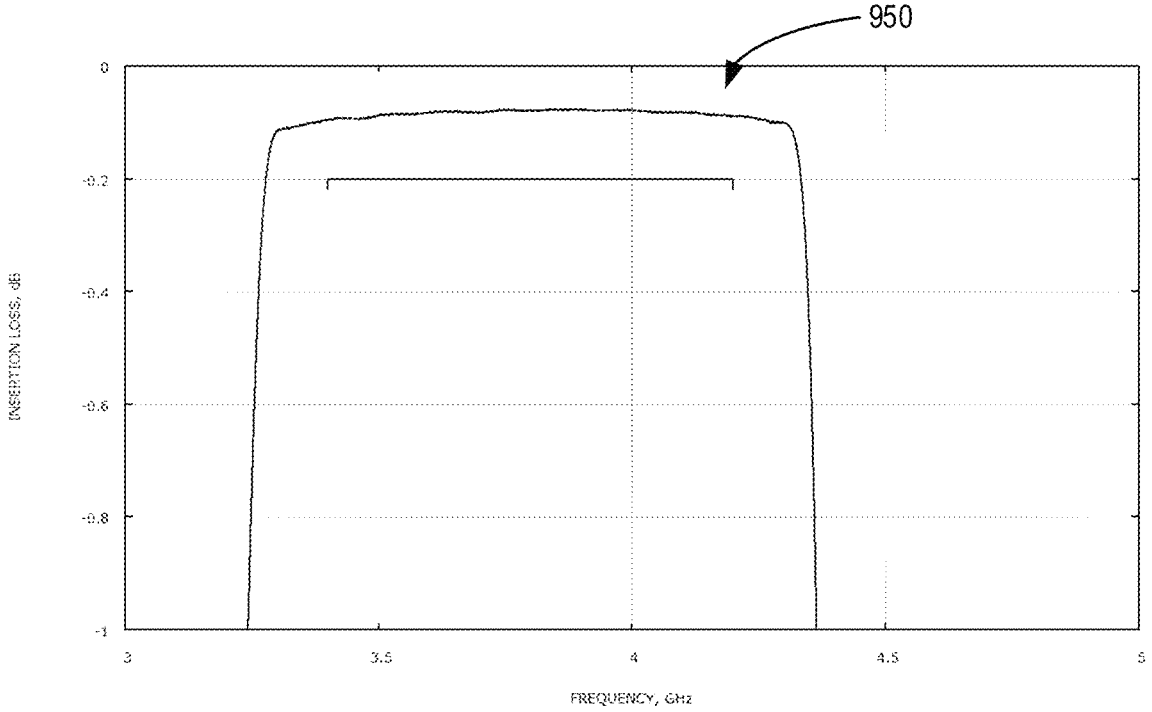
FIG. 9B shows a plot illustrating insertion loss over a range of frequencies including the passband frequency range for an example implementation of the filter of FIGS. 8A-8C.

FIG. 9B illustrates a plot 950 of insertion loss over a range of frequencies including the passband frequency range for an example implementation of the filter 800. As shown in plot 950, the filter 800 achieves low insertion loss (0.1 dB) and a further reduced insertion loss over the passband bandwidth (3.4-4.2 GHz). Using the bandpass filter section 800*a* in place of a corrugated filter to provide near-band rejection can contribute to the loss reduction seen in plot 950. Additionally, the bandpass filter section 800*a* can be configured to attenuate TE20-mode. This may allow the filter 800 to use a smaller low-pass filter section 800*b* with reduced insertion loss.

Figure 10:
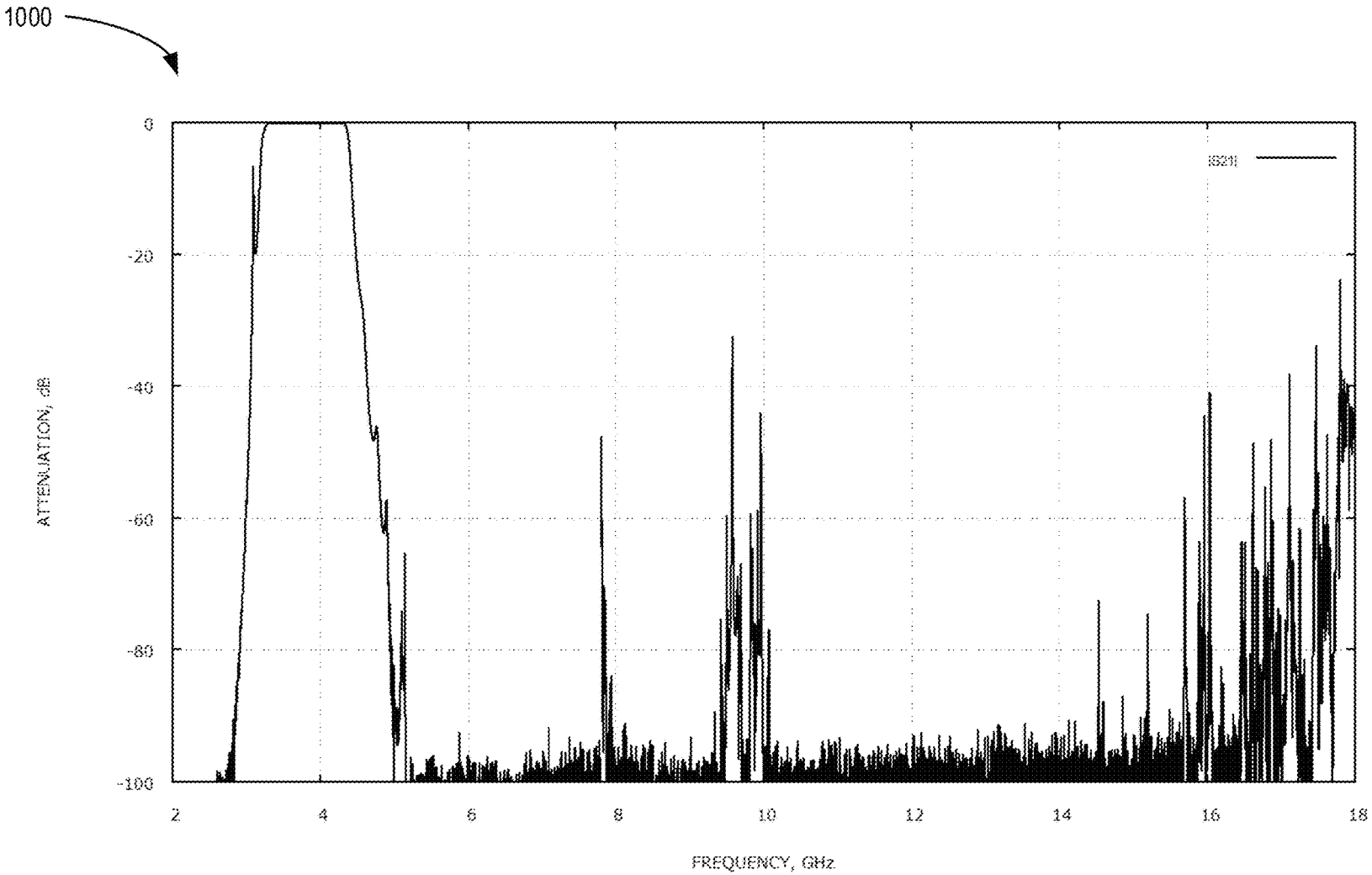
FIG. 10 shows a plot illustrating out-of-band rejection measured over a range of frequencies outside the passband frequency range for an example implementation of the filter of FIGS. 8A-8C.

FIG. 10 illustrates a plot 1000 illustrating out-of-band rejection over a range of frequencies outside the passband frequency range for an example implementation of the filter 800. The out-of-band rejection shown in plot 1000 was measured using linear tapers, which simulate a TE10-mode measurement. As shown in plot 1000, there is a wide stop-band with higher-order mode suppression.

Specific implementations of the example filters described herein can be designed using common filter synthesis and optimization methods. Filter hardware may be manufactured using various methods, such as providing two symmetrical parts that can be combined to define the resonator cavities, machined from aluminum (or other suitable materials, such as suitable metal alloys) using milling or other simple machining techniques. The filter hardware may be finished using various suitable conductive finishes (e.g. silver) and assembled in a common manner (e.g. using screws).

In some cases, the filters 300/600/800 may facilitate manufacturing with little or no tuning. For example, in some wide-band applications the filters may be designed with sufficient tolerances to avoid the need for tuning. The resonant cavities 200/250 used in examples of filters 300/600/800 may be provided with fixed cavity walls. This may simplify manufacturing by omitting any tunable components in the resonant cavities 200/250. For instance, the electrical equivalency of the cavity size of each resonant cavity 200/250 in some examples of filters 300/600/800 may be fixed.

Embodiments described herein may provide a number of advantages over existing bandpass filter implementations. For example, embodiments of the waveguide bandpass filters described herein may provide a single waveguide filter that enables high power operation, with low loss and a broadband spurious-less stop-band, in a compact filter. Depending on the specific application requirements, embodiments of the bandpass filters described herein may be implemented individual or combined as part of a filter assembly or cascade (see e.g. FIGS. 8A-8C). In either configuration, embodiments of the bandpass filters described herein may improve insertion loss, filter size and mass, out-of-band rejection and manufacturing cost as compared to existing solutions.

Embodiments described herein may also provide bandpass filters suitable for wide-band applications. For example, embodiments described herein may facilitate wide band operation across wider C-band downlink frequencies (e.g. 3.4-4.2 GHz) while also achieving improvements in power handling, insertion loss, and manufacturing size and cost. These features may be particularly useful in applications for satellite communications, such as satellite multiplexers, as well as other multiplexer applications.

Embodiments of the bandpass filters described herein may also enable implementations with dual-mode and non-resonant mode coupling. By integrating a capacitive iris into the resonator cavities, the frequency response of the resonators used to construct the bandpass filter can be designed to selectively integrate additional resonance into the filter response. This may allow broadband band-pass filters to be implemented with attenuation poles (e.g. quasi-elliptic), for example, or to control filter roll-offs (e.g. define symmetric filter roll-offs, or tilt the filter roll-offs left or right).

Integrating a capacitive iris into the cavity of the individual resonators can also allow the overall length of the filter to be reduced. The length of individual resonator cavities may be reduced due to capacitive loading, and thus overall filter length may be reduced in turn.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A bandpass filter comprising:

a) a plurality of resonant cavities, each resonant cavity configured to define the same fundamental resonant frequency, the plurality of resonant cavities arranged into a sequence of adjacent resonant cavities;

b) a plurality of coupling irises, with one of the coupling irises positioned between each pair of adjacent resonant cavities;

wherein each resonant cavity includes a plurality of cavity sections;

each resonant cavity includes a capacitive iris positioned coupling the cavity sections to one another; and the frequency of secondary resonance modes varies amongst the resonant cavities in the plurality of resonant cavities.

2. The bandpass filter of claim 1, wherein each resonant cavity has a rectangular outer profile.

3. The bandpass filter of claim 2, wherein the size of the rectangular outer profile varies amongst the resonant cavities in the plurality of resonant cavities.

4. The bandpass filter of claim 1, wherein each capacitive iris is positioned centrally within the corresponding resonant cavity.

5. The bandpass filter of claim 1, wherein the plurality of resonant cavities include a plurality of H-shaped resonant cavities.

6. The bandpass filter of claim 1, wherein the plurality of resonant cavities include a plurality of Π-shaped resonant cavities.

7. The bandpass filter of claim 1, wherein the fundamental resonant frequency of the plurality of resonant cavities is selected to define a passband in the range of 3.4 GHz to 4.2 GHz.

8. A filter comprising the bandpass filter of claim 1 cascaded with a lowpass filter.

9. The bandpass filter of claim 1, wherein the plurality of resonant cavities includes an input resonant cavity, at least one intermediate resonant cavity, and an output resonant cavity;

the input resonant cavity, at least one intermediate resonant cavity, and output resonant cavity are arranged into the sequence from the input resonant cavity to the output resonant cavity with the at least one intermediate resonant cavity positioned between the input resonant cavity and the output resonant cavity;

the input resonant cavity is connected to a signal input interface; and the output resonant cavity is connected to a signal output interface.

10. The bandpass filter of claim 9, wherein the plurality of resonant cavities are arranged linearly.

11. The bandpass filter of claim 10, wherein the signal input interface and signal output interface are arranged linearly with the plurality of resonant cavities.

12. The bandpass filter of claim 1, wherein each resonant cavity includes a pair of cavity sections, and the capacitive iris is positioned between the pair of cavity sections.

13. The bandpass filter of claim 1, wherein each coupling iris is an inductive iris.

14. The bandpass filter of claim 1, wherein a) each resonant cavity has an outer cavity profile;

b) for each resonant cavity, the corresponding outer cavity profile occupies a corresponding cavity volume; and c) the cavity volumes vary amongst the plurality of resonant cavities.

15. The bandpass filter of claim 1, wherein a) each resonant cavity has an outer cavity profile;

b) for each resonant cavity, the corresponding outer cavity profile occupies a corresponding cavity volume; and c) the cavity volumes are the same for each resonant cavity.

* * * * *